US009945043B2

(12) United States Patent
Macneil

(10) Patent No.: US 9,945,043 B2
(45) Date of Patent: Apr. 17, 2018

(54) ELECTRO CHEMICAL DEPOSITION APPARATUS

(75) Inventor: John Macneil, Vale of Glamorgan (GB)

(73) Assignee: SPTS Technologies Limited, Newport (GB)

( * ) Notice: Subject to any disclaimer, the term of this patent is extended or adjusted under 35 U.S.C. 154(b) by 588 days.

(21) Appl. No.: 13/994,198

(22) PCT Filed: Dec. 8, 2011

(86) PCT No.: PCT/GB2011/052437

§ 371 (c)(1),
(2), (4) Date: Aug. 15, 2013

(87) PCT Pub. No.: WO2012/080716

PCT Pub. Date: Jun. 21, 2012

(65) Prior Publication Data

US 2013/0313124 A1 Nov. 28, 2013

Related U.S. Application Data

(60) Provisional application No. 61/423,154, filed on Dec. 15, 2010.

(30) Foreign Application Priority Data

Dec. 16, 2010 (GB) ..... 1021326.2

(51) Int. Cl.
*C25D 5/02* (2006.01)
*C25D 5/08* (2006.01)
(Continued)

(52) U.S. Cl.
CPC ..... *C25D 17/001* (2013.01); *C25D 5/022* (2013.01); *C25D 5/08* (2013.01); *C25D 7/123* (2013.01);
(Continued)

(58) Field of Classification Search
CPC ..... C25D 7/123; C25D 5/022; C25D 5/08; C25D 17/001; C25D 17/004; C25D 17/02; C25D 21/02; C25D 21/18
See application file for complete search history.

(56) References Cited

U.S. PATENT DOCUMENTS

2001/0020583 A1* 9/2001 Woodruff ..... C25D 17/001 204/242
2002/0029978 A1* 3/2002 Talieh ..... H01L 21/2885 205/430
(Continued)

FOREIGN PATENT DOCUMENTS

WO 99/01592 A1 1/1999

*Primary Examiner* — Ciel P Thomas
(74) *Attorney, Agent, or Firm* — McNees Wallace & Nurick LLC

(57) ABSTRACT

This invention relates to apparatus for electrochemical deposition onto the surface of a substrate. The apparatus includes an anode electrode 13 a support 12 for supporting the substrate 11 with its one surface 21 exposed at a location, the support 12 and the anode electrode 13 being relatively movable to alter the gap between the anode 13 and the location to define a chamber 23 between them and an electrical power source 18 with an ohmic contact to the seed layer 20 for creating a potential difference across the gap. The apparatus further includes a seal 14 for sealing with the seed layer 20 to define the fluid chamber 23; and the fluid inlet 16 and a fluid outlet 17 to the chamber 13.

9 Claims, 6 Drawing Sheets

(51) Int. Cl.

| | |
|---|---|
| ***C25D 5/18*** | (2006.01) |
| ***C25D 7/12*** | (2006.01) |
| ***C25D 17/00*** | (2006.01) |
| ***C25D 17/02*** | (2006.01) |
| ***C25D 21/02*** | (2006.01) |
| ***C25D 21/18*** | (2006.01) |

(52) U.S. Cl.
CPC ..... *C25D 17/004* (2013.01); *C25D 17/02* (2013.01); *C25D 21/02* (2013.01); *C25D 21/18* (2013.01); *C25D 5/18* (2013.01)

(56) References Cited

U.S. PATENT DOCUMENTS

| | | | | |
|---|---|---|---|---|
| 2004/0104119 | A1 | 6/2004 | Edelstein et al. | |
| 2004/0124089 | A1* | 7/2004 | Basol ..... | C25D 5/06 205/137 |
| 2004/0237896 | A1* | 12/2004 | Hongo ..... | H01L 21/2885 118/719 |
| 2005/0164495 | A1 | 7/2005 | Chou et al. | |
| 2010/0258444 | A1 | 10/2010 | Weiner et al. | |

* cited by examiner

Diffusion time for Cu (D = 500 µm2/sec) and Suppressor –PEG – (D= 50 µm2/sec) as a function of TSV feature depth.

Theta powder XRD scan of ECD Cu deposition showing only Cu peaks.

ELECTRO CHEMICAL DEPOSITION APPARATUS

This invention relates to apparatus for electrochemical deposition onto the surface of a substrate having features formed in that surface and to methods of performing such deposition.

Electrochemical deposition (ECD) is widely used in the manufacture of printed circuit boards, semi-conductors, devices and hard disk drive manufacture. In semi-conductor applications the process is often used for depositing Cu. In the prior art constructions and methods, a wafer is placed in a bath of chemicals—principally $CuSO_4/H_2SO_4$ in H2O plus small quantities of organic additives. A DC potential is applied between an immersed metal electrode—typically Cu or Pt—and a continuous Cu seed layer, which has been pre-coated on a wafer, for example using a physical vapour deposition (PVD). Fluid is re-circulated in the bath to avoid depletion of the chemicals.

Cu+ ions are generated at the anode in the electrolyte. The substrate is negatively charged with respect to the metal anode with the result that Cu+ ions are attracted to the wafer surface.

When the surface of the wafer, or other substrate, being coated is not flat there are often small features such as channels or vias in the substrate, which result in it becoming difficult to maintain a uniform deposition rate within the small features. One particular example is that of Through Silicon Vias (TSVs) where relatively small vias from 100 μm to 1 μm with aspect ratios of 1:1 to 30:1 need to be filled with metal. FIG. 1 is a figure issued by the ITRS Committee, which shows an expectation that ECD Cu will be limited to low aspect ratio features with relatively large feature sizes (AR>10:1 and feature size >~2 μm).

The current ECD procedures have a number of difficulties:

1. Separate baths, with different electrolyte compositions, are generally needed to allow for varying deposition rates as the process proceeds and, for example, the vias become less and less deep.

2. The depletion of chemicals and the agitation in the vicinity of the wafer and the need for chemical additives both to enhance and suppress deposition in respective selected areas on the substrate.

3. The current ECD systems are large complex pieces of tooling into which fragile wafers have to be inserted and removed from whilst maintaining cleanliness and flow timings.

4. The chemicals in each batch have to be maintained free of particles and the fluid has to be constantly replenished with the result that only a small part of the Cu in the chemicals is actually deposited.

The Applicant's invention helps to mitigate, in at least some embodiments, one or more of these problems.

From one aspect the invention consists in apparatus for electrochemical deposition onto the surface of the substrate having features formed in that surface and the substrate having a conducting seed layer pre-deposited on the feature incorporating surface, the apparatus including an anode electrode, a support for supporting the substrate with its one surface exposed at a location, the support and the anode electrode being relatively moveable to alter the gap between the anode electrode and the location to define a chamber between them; and an electrical power source for creating a potential difference across the gap characterised in that the apparatus further includes a seal for sealing with the seed layer to form a fluid chamber and a fluid inlet and outlet to the chamber.

The fluid inlet and outlet may be formed in the electrode or through passages in other parts of the chamber and respective valves may be provided for opening and closing the inlet and outlet.

The seal may be carried by the anode electrode or by the chamber which contains the anode. The depth of the chamber may be at least an order of magnitude less than its cross-sectional dimension. The anode electrode may support an electrical contact, electrically isolated from the anode, for contacting the seed layer to complete an electrical circuit.

The apparatus may further include a fluid supply for the chamber. In that case it may further include a control for varying the chemical composition of the fluid in accordance with the degree to which the features have been plated and/or for pulsing fluid into and out of the chamber. The power supply may be pulsed or continuous. Typically the electrode will be positive with respect to the seed layer.

From another aspect the invention consists in a method of electroplating a substrate having features in a surface including:

(a) depositing a seed layer of a conductor onto the surface;
(b) positioning the substrate on a support with the surface exposed;
(c) locating the substrate in sealed opposed relationship with an electrode so as to form a chamber between;
(d) filling the chamber with an electrolyte;
(e) creating a potential difference between the anode electrode and the seed layer;
(f) removing the potential difference between the anode and the seed layer cathode;
(g) subsequently emptying the chamber; and
(h) refilling the chamber with electrolyte and repeating steps (d) to (g) until the substrate is plated as intended.

The depth of the chamber may be at least in order of magnitude less than its cross-sectional dimension. The potential difference created may be pulsed and the support may be cooled or heated relative to the electrolyte temperature.

The period between steps (d) and (e) may be less than or equal to 30 seconds. The method may include varying over time one or more of the chemical compositions of the electrolyte; the period between steps (d) and (e); the period of the creation of the potential difference; the magnitude of the potential difference and the volume of the chamber.

Although the invention has been defined above it is to be understood it includes any invented combination of the features set out above or in the following description.

The invention may be performed in various ways in specific embodiments will now be described with reference to the accompanying drawings in which.

Figure 1B:
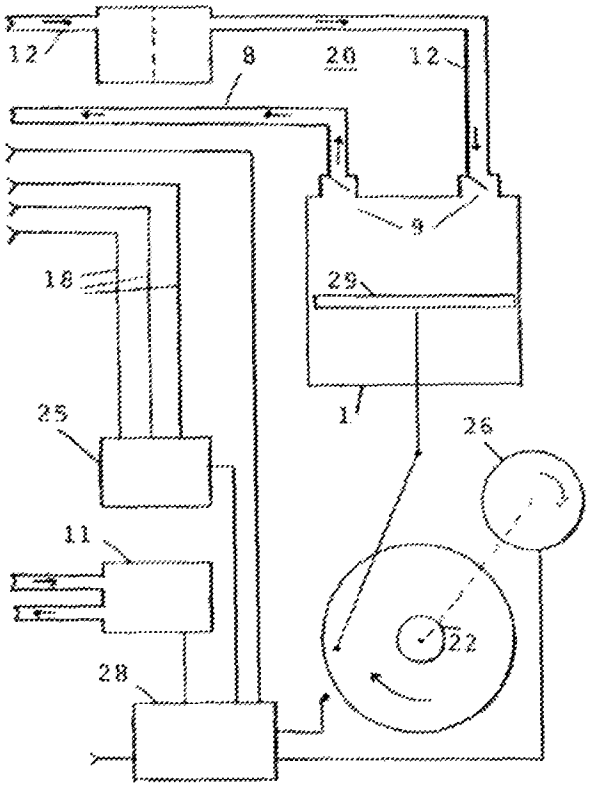
FIG. 1 is TSV diameter vs aspect ratio projections from ITRS 2009.
Figure 1A:
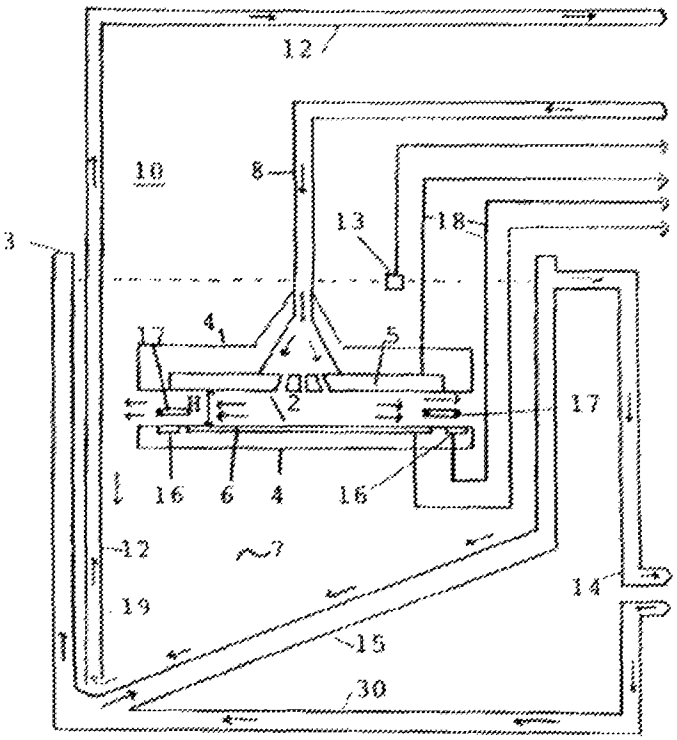
Figure 2:
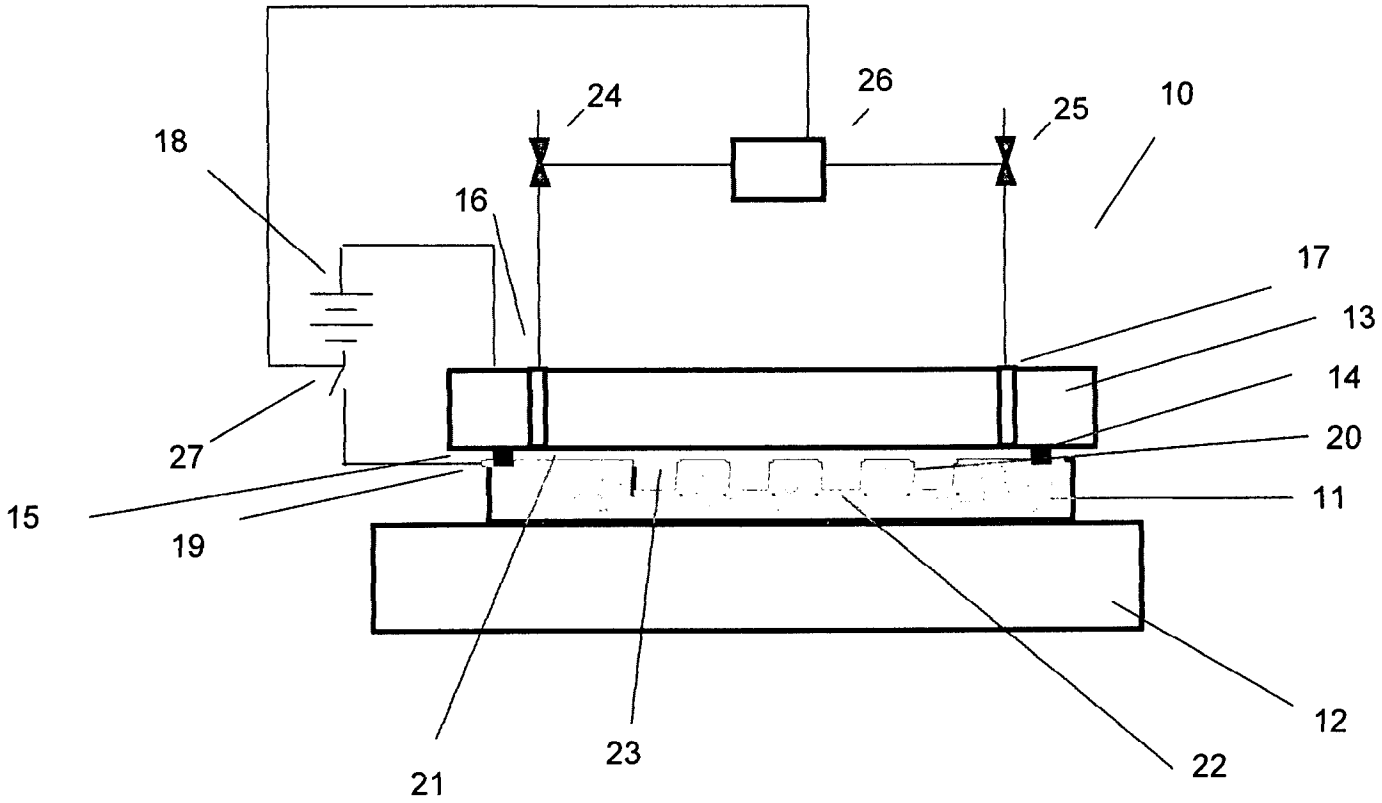
FIG. 2 is a schematic cross-sectional view of the apparatus and the substrate.

Turning to FIG. 2 apparatus, generally indicated at 10, and a wafer 11 are illustrated in schematic cross-section. The apparatus 10 includes a substrate table or chuck 12 and an anode electrode 13. In order to achieve a uniform electric field, the anode electrode 13 is preferably at least as extensive as the substrate and may conveniently extend beyond the substrate. Typically the anode electrode 13 will be at least coextensive with the chuck 12. The electrode 13 carries a ring seal 14 on its face 15 which is opposed to the substrate table 12 and has a fluid inlet 16 and a fluid outlet 17 located within the area defined by the seal 14. Preferably the inlet 16 and/or the outlet 17 may be closed and opened, for example by respective remotely operable valves. The electrode 13 has a DC supply 18 with an electrode indicated at 19 that contacts a pre-deposited seed layer 20 on a surface 21 of the wafer 11. It will be observed that the surface 21 has a number of features 22 formed in its surface. These could for example be TSVs.

In use, a wafer 11, for example, is placed on the substrate table 12 and the electrode is moved into the position indicated in FIG. 2 where the seal 14 engages against the seed layer 20 so as to encircle the features 22. In this position a chamber 23 is defined between the wafer 11 and electrode 13. A volume of electrolyte is introduced into the chamber 23 through the inlet 16 and quickly fills the features 22. The flow of electrolyte can be controlled by valves 24 and 25 under the control of control circuit 26, which may also control the DC supply 18, for example for pulse operation. (These features are shown in relation to FIGS. 3 and 4 for clarity but may exist in all embodiments.) The electrolyte is allowed to dwell in the chamber 23 for a sufficient period for Cu+ ions to reach the base of the features 22 under the potential difference created by the power supply 18. Preferably the dwell period is achieved by closing the inlet 16 and/or outlet 17. It will be appreciated that the seed layer 20 is negative with respect to the electrode 13. Because of the small volume of electrolyte involved this can happen quickly and the fluid is then pumped out to be replaced with a new charge of fluid. Further as the surface being coated is facing upwardly bubbles, which would lead to non-uniform coating, will not be retained against it.

The system has several advantages. First, because small amounts of fluid have been used efficiently, chemical consumption can readily be reduced. Secondly the period of dwell and the chemical composition of the electrolyte can be readily varied over time. As the features 22 begin to fill, the diffusion time for the Cu+ ions is reduced and this, for example, can be taken into account. Further the system is likely to reduce or remove the need for accelerators and suppressors. Further this variation does not require a number of different baths and the system can easily be tuned to the particular construction of the wafer or other substrate concerned.

Figure 3:
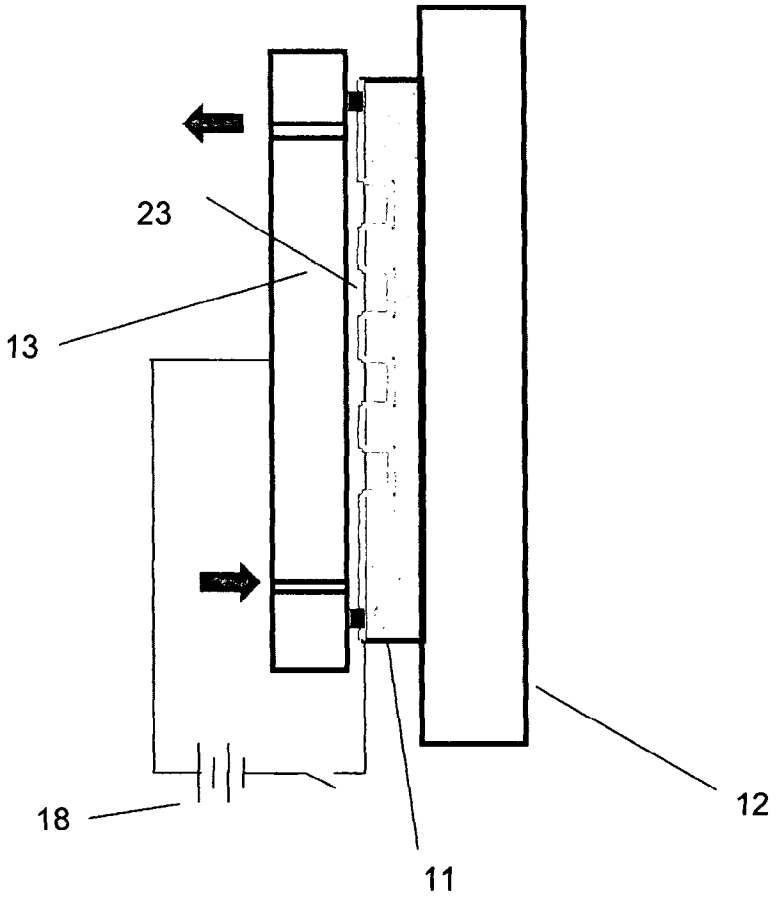
FIG. 3 illustrates the apparatus in a different orientation.
Figure 4:
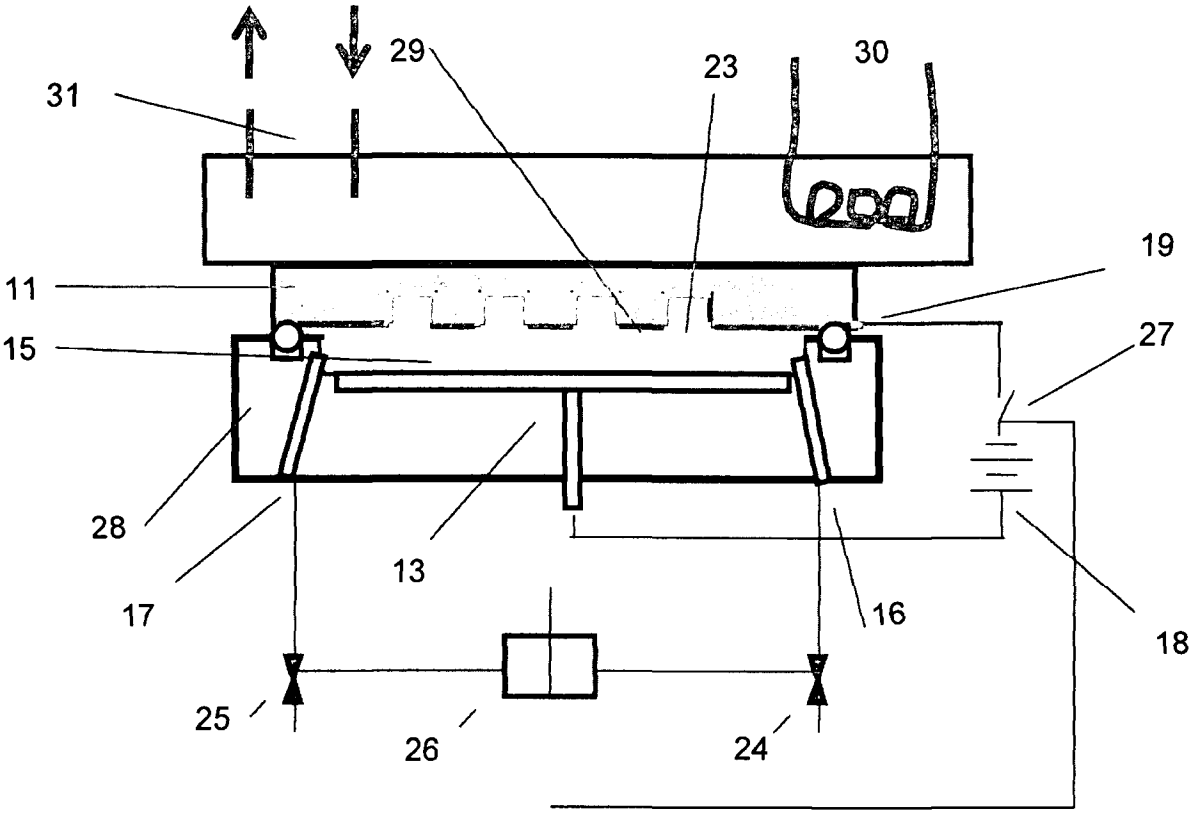
FIG. 4 illustrates the apparatus of third orientation.

FIG. 3 shows the apparatus being used in an alternate configuration and FIG. 4 shows the apparatus fully inverted. FIG. 4 also uses a dielectric container 28 where anode electrode 13 is retained. The substrate table 12 may include a heater 30 and/or a cooling circuit indicated at 31. Furthermore FIG. 4 also illustrates the possibility of masking the field areas of the wafer and thus reducing the need for subsequent post-deposition processes such as chemical mechanical polishing. This mask layer 29 may be in the form of a polymer membrane with suitable hole spacing matching the features or it could be a resistive mask and again can be used in each embodiment.

Although the apparatus has been described in terms of the deposition of Cu it can be used where other forms of ECD are utilised such as in the deposition of alloys for magnetic media and other films such as nano-laminates. The apparatus is particularly advantageous for the deposition of alloys as the depletion of components in the electrolyte fluids will not normally occur at the same rate.

By pulsing small volumes of fluid through the cavity, the electrolyte composition can be optimized throughout the plating cycle. Previously, this would normally have been achieved by moving a wafer between plating cells however due to practical considerations, the number of dedicated cells in one system, the electrolyte composition is typically a compromise to achieve process requirements at an acceptable throughput. A second advantage is that the depletion effects within TSV type features can be reduced. This is opposed to known agitation or re-circulating baths which at best case can achieve a boundary layer thickness of ~10 μm above the wafer. Conventional fountain cells have boundary layers quoted at ~60 μm. Within the TSV and the boundary layer transport is diffusion limited.

Figure 5:
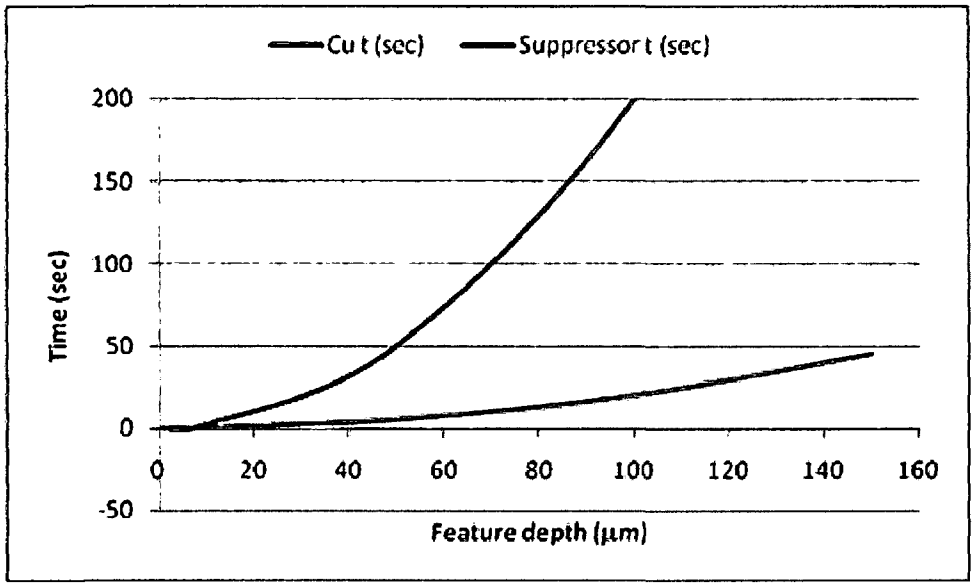
FIG. 5 is a chart of the diffusion time of Cu and a suppressor as a function of TSV feature depth.
Figure 6:
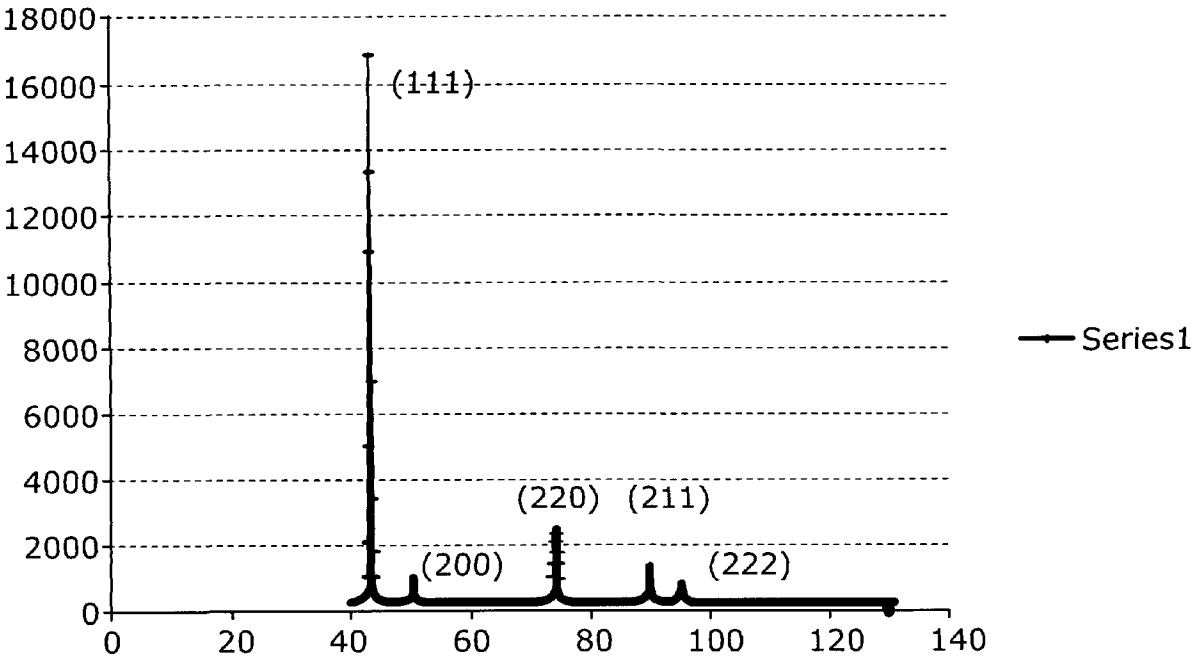
FIG. 6 is a theta powder XRD scan of ECD Cu deposition showing only Cu peaks.

Conventional acid based Cu plating electrolytes consist of $CuSO_4$, $H_2SO_4$, H2O and various organic additives. The additives tend to be suppressors (e.g. PEG) to reduce the deposition in the field areas, accelerators (brighteners such as SPS) which enhance deposition rate within the features to be filled and levelers to reduce deposition rate around sharp features e.g. at the top of a via. In FIG. 5 we can see that the diffusion time constant increases with the square of the depth of the TSV feature. In the case of Cu we find that a conventional 1 μm deep damascene feature has a time constant of ~0.002 sec while the 100 μm TSV is 20 sec. This increased to 45 sec for 150 μm TSV. The electrolyte composition and process used for conventional Cu damascene processing is therefore not well suited for deep TSV features. Inevitably process cycle times need to be extended due to the larger volume of material that needs to be electrochemically deposited into the features.

The new approach provides advantages over all of the issues identified and enables complex processes to be realised as the fluid streams could be rapidly changed. This would facilitate in-situ cleans or pre-deposition steps, subtle changes to the electrolyte as a function of time in the fill cycles or even laminate depositions (change material composition). Groups of modules could operate in series or parallel depending on the process requirements of each application.

The system designed is simplified over a conventional ECD system with wafer transport being minimised. All ECD steps could take place in one module. It might also be advantageous to carry out pre and post deposition steps in the same module though this would depend on the system configuration.

The ability to rapidly heat and cool the substrate temperature through the use of a chuck or ESC provides additional process flexibility over the current fluid bath approaches. It would also be possible to run the wafer and the process fluids at different temperatures. Something that it is not possible/very difficult to achieve in the conventional systems.

Ultrasonic or megasonic agitation of the cathode/cavity would be possible by attaching/coupling ultrasonic transducers to the cathode support. This could assist the process cycle by speeding up the removal of bubbles from the solution prior to deposition and the agitation of plating solutions during deposition. With the cathode assembly not being fully immersed in a plating solution the practical task of coupling the ultrasonic signal into the vicinity of the wafer surface becomes simpler to implement.

EXAMPLE

TABLE 1

Film thickness and resistivity uniformity for horizontal cell closed cell arrangement.

| Wafer - 200 nm PVD Cu | Rs av m-Ω/sq/3sigma (%) | T av μm/(max − min)/mean (%) | Resisitivity μΩ-cm |
|---|---|---|---|
| H | 2.51/7.41 | 6.63/7.54 | 1.72 |

Using a 150 mm wafer with 200 nm PVD Cu seed layer the average bulk resistivity of electroplated Cu is 1.716 m-cm. This is indicative of a high quality Cu deposition for an as-deposited (not annealed) film. There is tight control of resistivity & thickness of the coating at 7.41 & 7.54% respectively across the wafer.

The wafer was placed 10 mm below a copper anode, in a horizontal orientation, with a conventional CuSO4/H2SO4+HCl chemistry (50 g/Ltr Cu, 100 g/Ltr H2SO4, ~50 ppm Chloride ions) using a 15 mA/cm2 current density. The deposition cycle was 1200 sec with a deposition rate of 0.33 m/min. Anode to wafer (cathode) separation was 10 mm.

The presence of only Cu crystallographic peaks is once again indicative of a high quality ECD Cu film. The primary peak is the (111) orientation. This is similar to high quality PVD Cu films.

The invention claimed is:

1. Apparatus for electrochemical deposition on to a surface of a substrate having features formed in said surface, the substrate having a conductive seed layer pre-deposited on said surface;

the apparatus including an anode electrode;

a support for supporting the substrate with said surface exposed at a location having the features, the support and the anode electrode being relatively movable to alter a gap between the anode and the location to define a chamber between them;

a seal carried by the anode electrode or by a dielectric container where the anode electrode is retained for sealing with the seed layer encircling all of the features to form said chamber, the substrate in sealed opposed relationship with the anode electrode;

a fluid inlet and outlet to the chamber for passing an electrolyte through the chamber; and an ohmic contact to the seed layer for creating a potential difference across the gap between the anode electrode and the seed layer when the ohmic contact is coupled to an electrical power source, wherein when an electrolyte is passed through the chamber the electrolyte passes over a predetermined, fixed area of said surface of the substrate which includes the features.

2. Apparatus as claimed in claim 1 wherein said fluid inlet and outlet are formed in the anode electrode or other part of the chamber.

3. Apparatus as claimed in claim 1 wherein the depth of the chamber is at least an order of magnitude less than its cross-sectional dimension.

4. Apparatus as claimed in claim 1 wherein the anode electrode carries an electrically isolated electrical contact for contacting the seed layer to form the ohmic contact and to complete an electrical circuit.

5. Apparatus as claimed in claim 1 further comprising a fluid supply for the chamber.

6. Apparatus as claimed in claim 5 further comprising a control for varying the chemical composition of the fluid in accordance with the degree to which the features have been plated.

7. Apparatus as claimed in claim 6 further comprising a control for pulsing fluid into and out of the chamber.

8. Apparatus as claimed in claim 1 wherein the electrical power source is a pulsed supply.

9. Apparatus as claimed in claim 1 wherein the anode electrode is at least coextensive with the support.

* * * * *